US012018530B2

(12) United States Patent
Rives

(10) Patent No.: US 12,018,530 B2
(45) Date of Patent: Jun. 25, 2024

(54) RADIAL CUTTING ASSEMBLY FOR DRILLING TOOL

(71) Applicant: Allen Kent Rives, New Braunfels, TX (US)

(72) Inventor: Allen Kent Rives, New Braunfels, TX (US)

(73) Assignee: Allen Kent Rives, New Braunfels, TX (US)

( * ) Notice: Subject to any disclaimer, the term of this patent is extended or adjusted under 35 U.S.C. 154(b) by 0 days.

(21) Appl. No.: 17/997,061

(22) PCT Filed: May 4, 2021

(86) PCT No.: PCT/US2021/030615
§ 371 (c)(1),
(2) Date: Oct. 25, 2022

(87) PCT Pub. No.: WO2021/226055
PCT Pub. Date: Nov. 11, 2021

(65) Prior Publication Data

US 2023/0167691 A1 Jun. 1, 2023

(51) Int. Cl.

| | |
|---|---|
| ***E21B 10/32*** | (2006.01) |
| ***E21B 10/34*** | (2006.01) |
| ***E21B 10/567*** | (2006.01) |
| ***E21B 29/00*** | (2006.01) |
| *E21B 7/28* | (2006.01) |

(52) U.S. Cl.
CPC ..... *E21B 10/345* (2013.01); *E21B 10/322* (2013.01); *E21B 10/327* (2013.01); *E21B 10/567* (2013.01); *E21B 29/005* (2013.01); *E21B 7/28* (2013.01)

(58) Field of Classification Search
CPC ..... E21B 10/322; E21B 10/327; E21B 10/34; E21B 10/345
See application file for complete search history.

(56) References Cited

U.S. PATENT DOCUMENTS

| | | | | |
|---|---|---|---|---|
| 4,614,242 | A * | 9/1986 | Rives | E21B 10/345 175/269 |
| 6,668,949 | B1 | 12/2003 | Rives | |
| 2008/0115973 | A1 | 5/2008 | Rives | |
| 2008/0251294 | A1 | 10/2008 | Minshull | |
| 2009/0114448 | A1* | 5/2009 | Laird | E21B 10/34 175/61 |
| 2011/0220357 | A1* | 9/2011 | Segura | E21B 29/005 166/55.3 |
| 2015/0008041 | A1 | 1/2015 | Hall et al. | |
| 2018/0179825 | A1 | 6/2018 | Johnson et al. | |

OTHER PUBLICATIONS

International Search Report and Written Opinion of the International Searching Authority dated Aug. 12, 2021, in connection with International Application No. PCT/US2021/030615, 7 pages.

* cited by examiner

*Primary Examiner* — Giovanna Wright

(57) ABSTRACT

This cutting assembly provides a radially grooved body insert upon which cutter arms with complementary radial grooves may translate to extend the cutter arms in a radial fashion from a body of a downhole drilling assembly. This improved cutting assembly design can be incorporated into an underreamer, hole opener, drill bit, or section mill.

14 Claims, 7 Drawing Sheets

RADIAL CUTTING ASSEMBLY FOR DRILLING TOOL

CROSS-REFERENCE TO RELATED APPLICATIONS

This application is a 371 of International Application No. PCT/US2021/030615, filed May 4, 2021, which claims the benefit of U.S. Provisional Patent Application No. 63/019,844, filed May 4, 2020, which is incorporated herein by reference in its entirety.

FIELD

This application relates generally to downhole assemblies for enlarging boreholes. Specifically, this application relates to a cutting assembly for a drilling tool that allows for enlarging of boreholes with radially extending cutter arms.

BACKGROUND

Various downhole drilling assemblies have been and are currently being used to enlarge existing boreholes, including but not limited to underreamers and section mills. When enlarging a borehole, it is often preferable to drill a reduced diameter or "pilot" hole. Underreamers function to enlarge smaller pilot holes into finished larger-diameter boreholes. Often boreholes located below the lowest string of casing required bored diameters greater than the inner diameter of the preceding string of casing. For these circumstances, an underreamer may be installed behind a smaller drill bit and run through the casing to the lower bore location. Once below the casing, the collapsible underreamer is expanded and the larger borehole is drilled. Once the larger bore is complete, the underreamer is retracted and the entire drilling assembly, bit, measurement equipment, and underreamer, is retrieved through the newly drilled borehole and casing.

Section mills are designed to cut and mill an entire section of casing. Often, this is done to cut a window through the side of the casing or to remove a continuous section of the casing so that the wellbore may be deviated from the original well through the window or section removed. The cutting assembly of a section mill and underreamer utilize much of the same components, the main difference being the type of cutting elements used depending on the formation type and/or the casing size. The cutting assembly of the present disclosure may be utilized with underreamers, section mills, or any downhole drilling assembly in which cutter arms extend from a main body structure to enlarge a borehole.

Prior cutting assemblies have been limited as to the diameter of the enlarged hole because the cutter arms extend parallel to the downhole drilling assembly. This parallel movement is limiting because there is only a certain amount of space to work with within the confines of the tool. Many prior cutting assemblies are further limited by rotation around the center of the underreamer body and a single pivot point and pin. Further, the power with which the cutting assembly can open is limited in prior cutting assemblies due to the small or limited distance the cutter arms translate upon opening of the cutting assembly. Therefore, a need exists for an improved tool that allows for unique actuation and extension of the cutter arms from the drilling assembly body to maximize the deployment and overall function of the downhole drilling assembly.

SUMMARY

Devices and methods to enlarge boreholes are described herein. Embodiments generally include a cutting assembly of a downhole drilling assembly with at least one body insert installed within a main body, the body insert having at least one radial projection on at least one side; an extendable cutter arm having at least one radial groove slidably engaged with each radial projection of the body insert; a hydraulically engaged actuator capable of urging the cutter arms along the radial projections of the body insert; and the extendable cutter arm translates radially along the at least one radial groove between an extended and retracted position.

One or more embodiments include the cutting assembly of the preceding paragraph wherein the cutter arm pivots around an arc center of the radial projection of the body insert when the cutting assembly rotates.

One or more embodiments include the cutting assembly of any preceding paragraph with a stop block with at least one face fully engaged with an interior surface of the downhole drilling assembly, wherein upon full extension of the cutter arms a shoulder of the cutter arm abuts the stop block and mechanical forces acting on the cutter arm are transferred to the stop block and downhole drilling assembly.

One or more embodiments include the cutting assembly of any preceding paragraph wherein the cutter arm includes hardened cutter elements.

One or more embodiments include the cutting assembly of any preceding paragraph wherein the cutter arm includes polycrystalline diamond compact cutter elements.

One or more embodiments include the cutting assembly of any preceding paragraph wherein the cutter arm includes a roller cone.

Embodiments generally include a downhole drilling assembly comprising a tubular body with a fluid flow path, the tubular body comprising a main body moving telescopically within an outer body around the fluid flow path; a plurality of body inserts displaced within the main body, the body inserts having circumferentially spaced radial grooves; a plurality of moveable cutter arms with radial grooves complementary to and slidably engaged with the grooves of the body insert and at least one stop block; and a hydraulically engaged actuator cooperatively engaged with the cutter arms, wherein the actuator is capable of extending the cutter arms radially from the outer body until the cutter arm is seated against the at least one stop block to allow the cutter arm to rotate about a pivot point.

One or more embodiments include the downhole drilling assembly of any preceding paragraph with a plurality of jets installed within the actuator.

One or more embodiments include the downhole drilling assembly of any preceding paragraph wherein the pivot point is an arc center of the radial grooves.

One or more embodiments include the drilling tool of any preceding paragraph wherein the at least one stop block comprises an arcuate lower face adapted to fully engage a corresponding proximal edge surface of the outer body, and mechanical forces acting upon the cutting elements upon extension are supported by the at least one stop block and the outer body of the drilling tool.

Methods of enlarging a borehole are described herein, and embodiments generally include installing a downhole drilling assembly with a plurality of removable body inserts installed within the drilling assembly, each body insert having a plurality of radial projections slidably engaged with a cutter arm having a plurality of radial grooves; disposing the downhole drilling assembly at a desired location within a borehole; pressurizing a bore within the downhole drilling assembly to extend the cutter arms from the drilling tool body along a radial translation path; and rotating the drilling tool within the cutter arms in an extended position.

One or more embodiments include the method of any preceding paragraph, wherein the desired location is within casing of the borehole.

One or more embodiments include the method of any preceding paragraph, wherein the desired location is below casing of the borehole.

One or more embodiments include the method of any preceding paragraph, wherein the downhole drilling assembly further comprises a stop block adapted to abut a main body of the downhole drilling assembly and the cutter arms upon extension to absorb mechanical forces acting on the cutter arms and transfer the forces to the main body.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "disclosure" may in some cases refer to certain specific embodiments only. In other cases it will be recognized that references to the "disclosure" will refer to subject matter recited in one or more, but not necessarily all, of the claims. Each of the disclosures will now be described in greater detail below, including specific embodiments, versions and examples, but the disclosures are not limited to these embodiments, versions or examples, which are included to enable a person having ordinary skill in the art to make and use the disclosure when the information in this patent is combined with available information and technology.

Various terms as used herein are shown below. To the extent a term used in a claim is not defined below, it should be given the broadest definition skilled persons in the pertinent art have given that term as reflected in printed publications and issued patents at the time of filing.

Further, various ranges and/or numerical limitations may be expressly stated below. It should be recognized that unless stated otherwise, it is intended that endpoints are to be interchangeable. Any ranges include iterative ranges of like magnitude falling within the expressly stated ranges or limitations.

Illustrations of various embodiments of this disclosure are provided within FIGS. 1A through 7B.

Figure 1A:
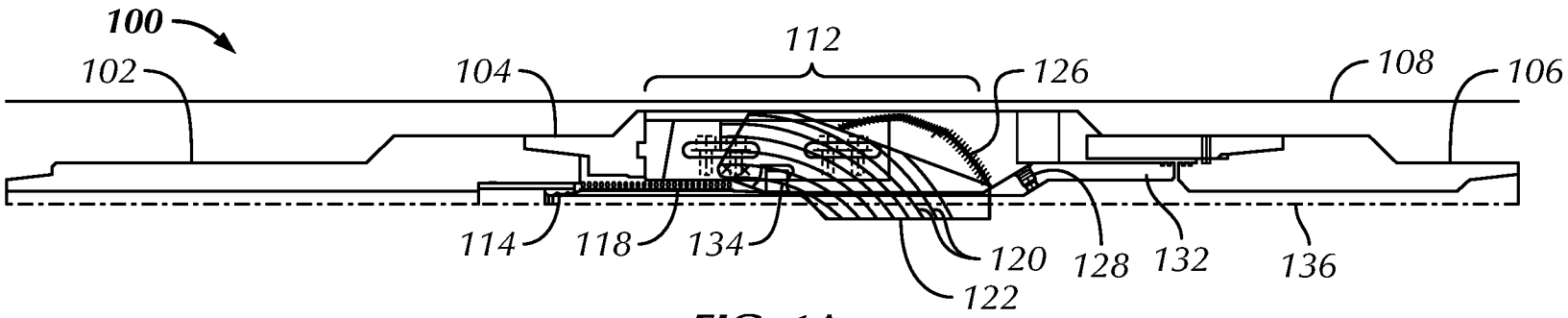
FIG. 1A is a schematic sectioned view of a downhole drilling assembly in a retracted position, in accordance with one or more embodiments disclosed herein.

FIG. 1A is a schematic sectioned view of a downhole drilling assembly 112 in a retracted position. An underreamer 100 is shown with three threaded subs, a top sub 102, a main body 104, and a bottom sub 106. However, it should be understood by one having ordinary skill in the art that multiple or single subs can be used to construct underreamer 100.

The top sub 102 provides a fluid flow path that allows hydraulic communication from a drillstring threaded to the top sub 102. Within top sub 102, there is a counterbore that fits an upper tube assembly.

Cutting assembly 112 has a body insert 124 installed within the main body 104. This body insert 124 has a series of radial grooves 120 that complement a series of radial grooves 125 on the cutter arms 122. When engaged, the cutter arms 122 translate along the radial grooves 120 of the body insert 124 to allow for expansion of the cutter arms 122 in a radial fashion. This movement continues until the cutter arms 122 abut a stop block 130 and can no longer move outward from the main body 104.

When the hydraulic pressure within the downhole drilling assembly is at a sufficient level to overcome the spring 118 bias, the actuator 132 urges the cutter arms 122, which then translate along the radial grooves 120 of the body insert 124. The cutter arms 122 thereby extend from the main body 104 through slots (not presently shown) on the outside of the body 104. The underreamer 100 rotates to abrade the pilot hole 108 with the cutter arms 122 and expand the pilot hole 108 to a desired diameter to form new underreamed hole 110.

The extension of the cutter arms 122 in a radial fashion creates greater power upon initial extension, and a greater resistance to the closure of the cutter arms 122 when the cutting assembly 112 is activated. Translation along the radial grooves 120 lengthens the distance the cutter arms 122 travel from their starting position within the main body 104 to full extension. This lengthened translation path means the cutter arms 122 have the most power upon initial actuation of the underreamer 100, with a slight fall off in power as the cutter arms 122 continue to open and move along the grooves 120. This differs from previous underreamers wherein the opening power increases as the arms open.

The pivot point about which the cutter arms 122 rotate is an arc center of the grooves 120. This creates a unique movement and rotation of the cutting assembly 112 from previous downhole drilling assemblies that have a single pivot point and pin relative to the center line of an underreamer body.

Figure 1B:
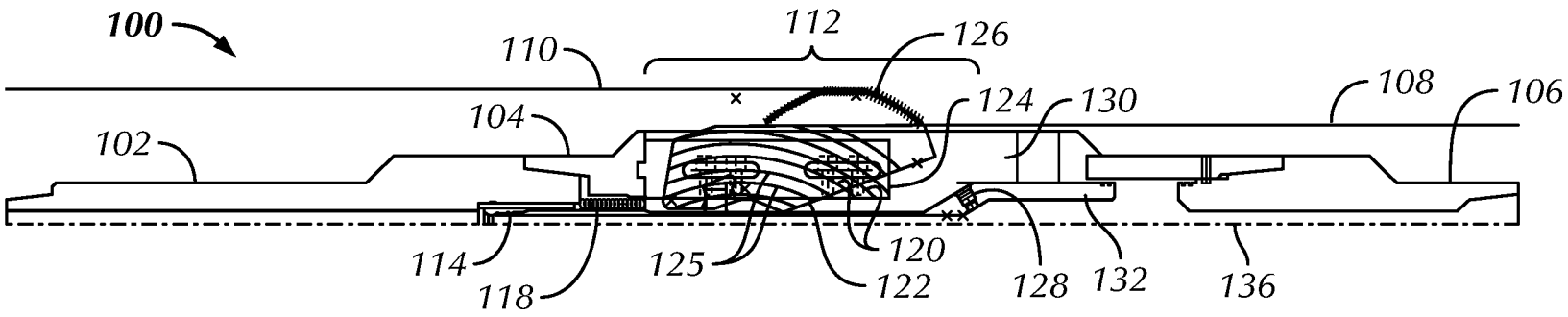
FIG. 1B is a schematic sectioned view of a downhole drilling assembly in an extended position, in accordance with one or more embodiments disclosed herein.

FIG. 1B is a schematic sectioned view of the underreamer 100 of FIG. 1A in an extended position. The bottom sub 106 provides a mechanism by which an external stimulus activates the actuator 132, thus extending the cutter arms 122 from the underreamer 100. The external control stimulus that activates the actuator 132 can be a ball drop feature wherein a ball is dropped through the drill string and pumped down to a ball drop sliding sleeve. Once the ball reaches the ball drop sliding sleeve, the sleeve moves down into the fixed ball drop sleeve.

Once the ball drop sliding sleeve moves down to the fixed ball drop sleeve, the actuator 132 is activated. The actuator 132 urges the cutter arms 122 along the radial grooves 120 of the body insert 124. Fluid flows through the jets 128 that are incorporated into the actuator 132. Fluid also flows through the ports in the fixed ball drop sleeve that routes fluid back into the inner diameter of the bottom sub 106.

Alternatively, the external control stimulus that activates the actuator 132 may be flow rate activated, wherein the actuator 132 is activated when the flow rate through a bore of the underreamer 100 is great enough to create a sufficient pressure drop to activate the device.

In either embodiment, a spring 118 provides an opposing force to that of the actuator 132, thus maintaining the cutter arms 122 in the retracted position until the actuator 132 can overcome the opposing bias of the spring 118 to extend the cutter arms 122. The spring 118 is compressed as the actuator 132 moves upward to extend the cutter arms 122.

To retract the cutter arms 122, the hydraulic pressure is increased and the spring 118 pushes the flow tube 134 back towards the actuator 132, thus urging the cutter arms 122 back within the confines of the underreamer 100. The underreamer 100 may then be removed from the borehole.

In the present disclosure, the cutter arms 122 extend radially from the main body 104. This radial extension of the cutter arms 122 allows for a larger diameter of the underreamed hole 110 because the cutter arms 122 travel along the radial grooves 120 of the body insert 124. The distance traveled by the cutter arms 122 is thus greater and the cutter arms can extend further from the main body 104, while still staying within the confines of the underreamer 100. In previous cutting assemblies, the cutter arms extended parallel to the drilling assembly or rotate about a single pin and pivot point. In the present disclosure, the cutter arms 122 are extending radially and pivot around an arc center of a radius on the grooves 120. When the cutting assembly 112 is engaged, the cutter arms 122 rotate to expand the borehole 108. This rotation is happening around an arc center of a radius of a groove 120 rather than a pivot point and pin type drilling tool, that rotates about a single pivot point and pin.

When the cutter arms 122 are in the extended position and the underreamer 100 is activated, the jets 128 emit fluid to cool and clean the cutting assembly 112 of debris. In the present disclosure, the jets 128 are incorporated into the actuator itself, rather than on the body of the underreamer. The jets are thus closer to the cutting assembly 112 and can clear debris from the radial grooves 120. Previous underreamers typically house the jets further down the underreamer body.

Figure 1C:
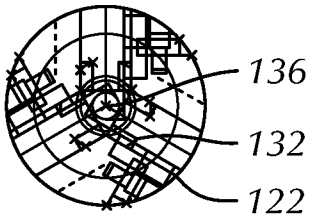
FIG. 1C is a schematic view of a downhole drilling assembly demonstrating the relative configuration of structures within the assembly, in accordance with one or more embodiments disclosed herein.

FIG. 1C is a schematic view of the underreamer 100 in FIGS. 1A and 1B demonstrating the relative configuration of structures within the underreamer 100. Shown are three cutter arms 122. However, the present disclosure allows for various configurations within the underreamer 100, and cutting assemblies 112 with two or more cutter arms 122 are contemplated herein.

Figure 2A:
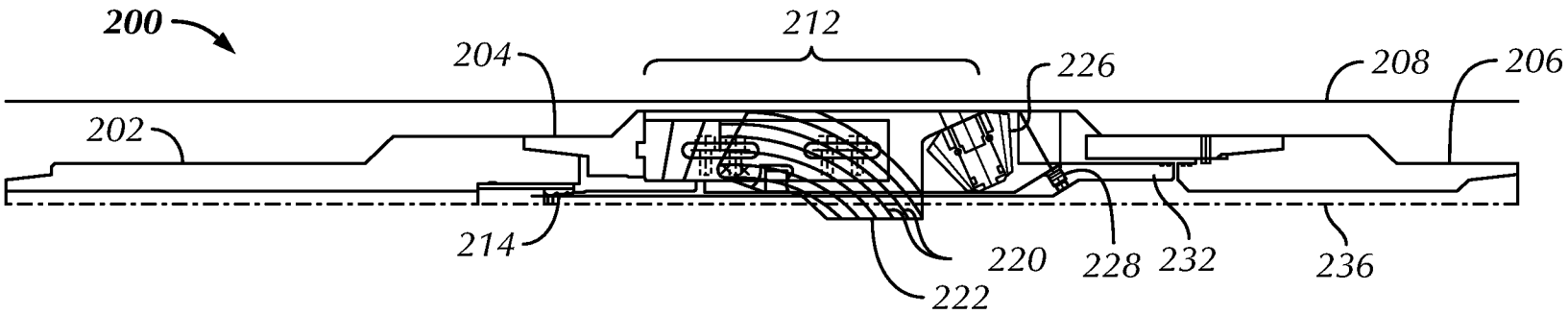
FIG. 2A is a schematic sectioned view of a downhole drilling assembly with roller cone cutters in a retracted position, in accordance with one or more embodiments disclosed herein.

FIG. 2A is a schematic sectioned view of a downhole drilling assembly 200 with roller cone cutters 226 in a retracted position. The cutting assembly 212 of the underreamer 200 has the same radial grooves 220 configuration as shown in FIGS. 1A and 1B. A roller cone cutter 226 is attached to a cutter arm 222 and extends from the main body 204 in a radial fashion. Fluid pressure inside of the fluid flow path 236 is utilized to hydraulically extend the cutter arms 222 with roller cone cutters 226 along the radial grooves 220. This radial extension allows for greater opening power of the cutter arms 222, and allows for rotation around an arc center of the radial grooves 220 upon extension of the cutter arms 222. The cutter arms 222 can be preadjusted to a desired diameter prior to drilling, depending on the needs of a particular job. Different desired diameters are demonstrated in FIGS. 2B and 2C.

Figure 2B:
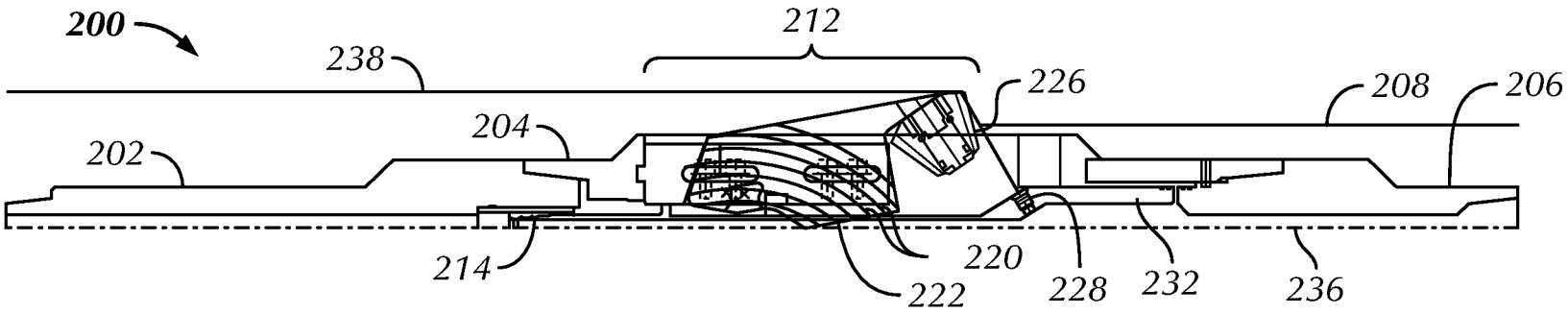
FIG. 2B is a schematic sectioned view of a downhole drilling assembly with roller cone cutters in a first extended position, in accordance with one or more embodiments disclosed herein.
Figure 2C:
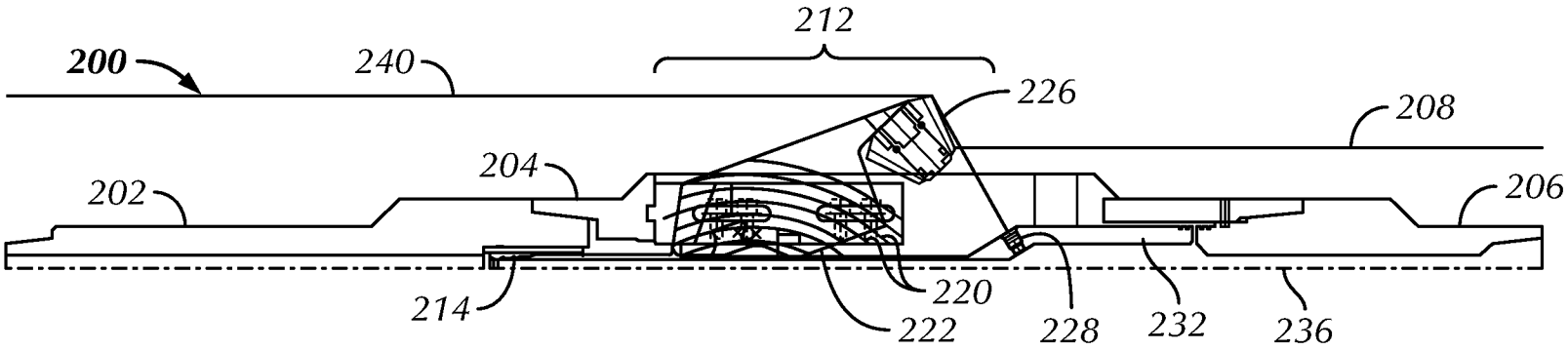
FIG. 2C is a schematic sectioned view of a downhole drilling assembly with roller cone cutters in a second extended position, in accordance with one or more embodiments disclosed herein.

FIGS. 2B and 2C demonstrate the underreamer 200 of FIG. 2A with cutter arms 222 and roller cone cutters 226 in an extended position. The underreamer 200 rotates upon extension of the cutter arms 222 to drill the pilot hole 208 to a desired diameter. FIG. 2B shows an underreamed hole drilled to a first diameter 238. FIG. 2C shows an underreamed hole drilled to a second diameter 240.

Figure 2D:
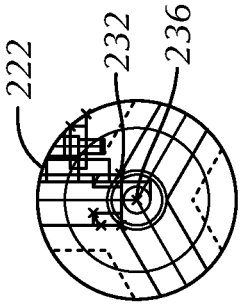
FIG. 2D is a schematic view of a downhole drilling assembly demonstrating the relative configuration of structures within the assembly, in accordance with one or more embodiments disclosed herein.

FIG. 2D is a schematic view of the underreamer 200 in FIGS. 2A through 2C demonstrating the relative configuration of structures within the underreamer 200. Shown is a single cutter arm 222. However, it should be understood by those having ordinary skill in the art that the cutting assembly may have two or more cutter arms 222.

Figure 3A:
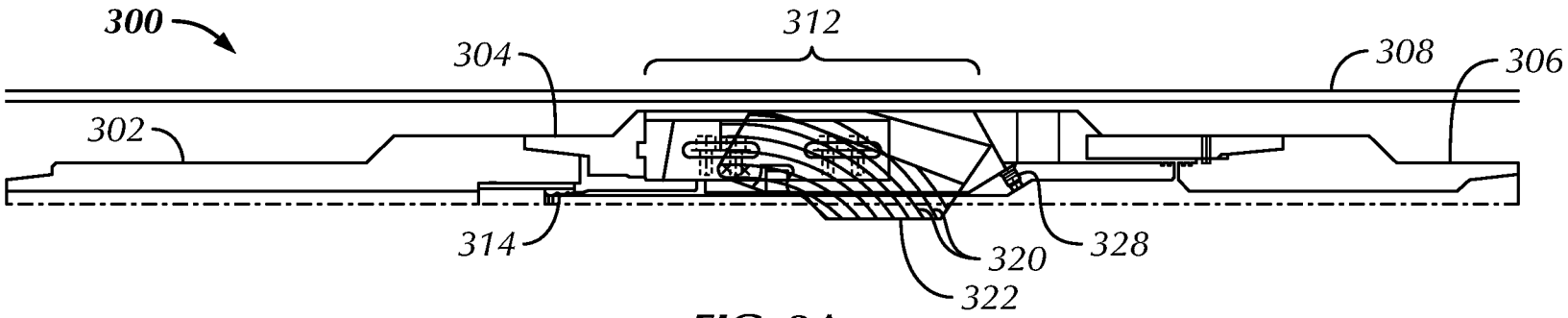
FIG. 3A is a schematic sectioned view of a downhole drilling assembly positioned within the casing of a borehole in a retracted position, in accordance with one or more embodiments disclosed herein.

FIG. 3A is a schematic sectioned view of a section mill 300 positioned within the casing 308 of a borehole in a retracted position. The section mill 300 is used to cut and mill a section of casing 308. Once the cutting assembly 312 is positioned at a selected cut point, the section mill 300 rotates and the cutter arms 322 are hydraulically actuated to extend from the main body 304. Once extended, the cutter arms 322 abrade the casing wall 308 to create a new milled section 310. The cutter arms 322 can optionally be manufactured of tungsten carbide coated knives, or have additional cutting elements on the distal end of the cutter arm 322.

Figure 3B:
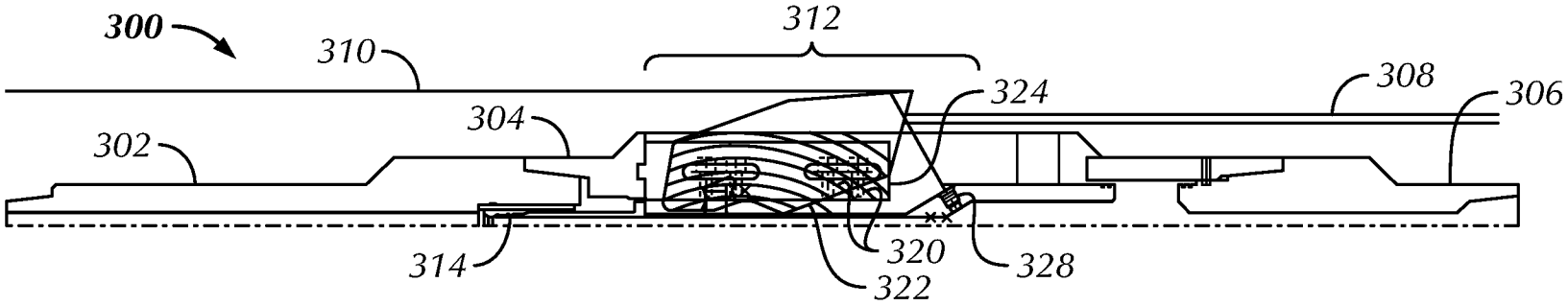
FIG. 3B is a schematic sectioned view of a downhole drilling assembly positioned within the casing of a borehole in an extended position, in accordance with one or more embodiments disclosed herein.

FIG. 3B is a schematic sectioned view of a downhole drilling assembly 300 positioned within the casing 308 of a borehole in an extended position. When the cutter arms 322 are hydraulically extended from the main body 304, the cutter arms 322 move along the radial grooves 320 of the body insert 324 and extend from the section mill 300 in a radial fashion. The cutter arms 322 rotate along an arc center of the radial grooves 320, rather than around a single pivot point and pin.

Figure 3C:
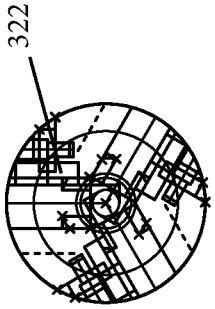
FIG. 3C is a schematic view of a section mill demonstrating the relative configuration of structures within the section mill, in accordance with one or more embodiments disclosed herein.

FIG. 3C is a schematic view of the section mill 300 in FIGS. 3A and 3B demonstrating the relative configuration of structures within the section mill 300. Shown are three cutter arms 322. However, the present disclosure allows for various configurations within the section mill 300, and cutting assemblies 312 with two or more cutter arms 322 are contemplated herein.

Figure 4A:
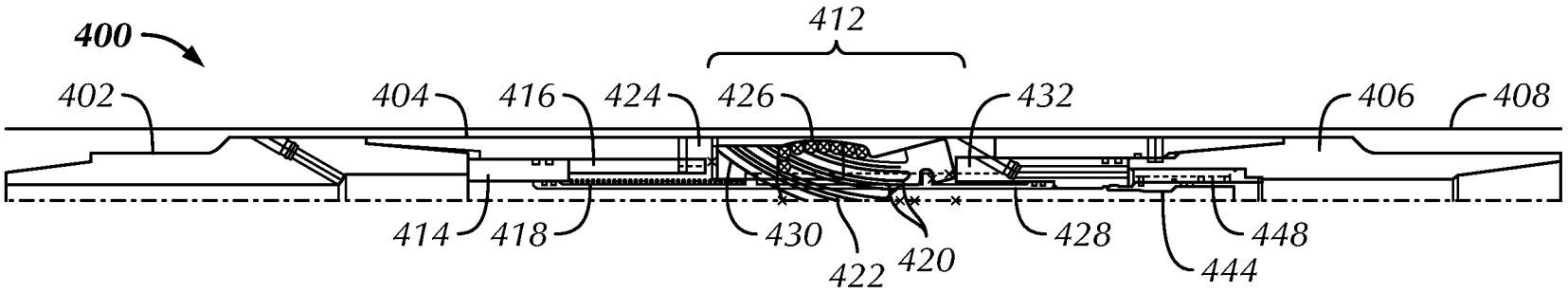
FIG. 4A is a schematic sectioned view of a downhole drilling assembly in a retracted position with an alternative embodiment of the cutting assembly, in accordance with one or more embodiments disclosed herein.
Figure 4B:
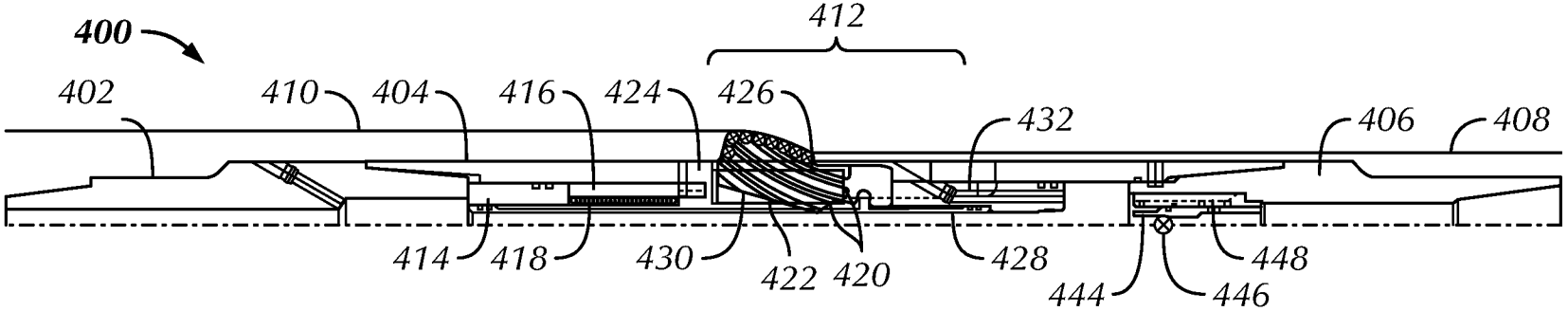
FIG. 4B is a schematic sectioned view of a downhole drilling assembly in an extended position with an alternative embodiment of the cutting assembly, in accordance with one or more embodiments disclosed herein.

Referring to FIGS. 4A and 4B, an alternative embodiment of the cutting assembly 412 is shown. The radial grooves 420 of the body insert 430 are curved such that the cutter arms 422 open towards the uphole end of the underreamer 400. This contrasts with the cutting assembly 112 shown in FIGS. 1A through 3C, where the radial grooves 120 are oriented such that the cutter arms 122 open towards the downhole side of the underreamer 100. The present disclosure allows for either orientation of the cutting assembly 412. In each embodiment, the cutter arms 422 extend from the main body 404 in a radial fashion and translate along the radial grooves 420 of the body insert 430. FIG. 4B is a schematic sectioned view of the underreamer 400 of FIG. 4A in an extended position. The cutter arms 422 open towards the uphole end of the underreamer 400 when they translate along the radial grooves 420, rather than the downhole end.

As shown, a cutter arm 422 is fully extended from the underreamer 400. The cutter arm 422 is able to expand the original pilot hole 408 to a larger, underreamed hole 410 with a desired diameter. The actuator 432 then pushes the cutter arms 422 along the radially grooved body insert 430 until the cutter arms 422 abut a stop block 424 and can no longer move outward from the main body 404.

This underreamer comprises a top sub 402, a main body 404, and a bottom sub 406. However, it should be understood by one having ordinary skill in the art that multiple or single subs can be used to construct underreamer 100.

The bottom sub 406 provides a mechanism by which an external stimulus activates the actuator 432, thus extending the cutter arms 422 from the main body 404. The external control stimulus that activates the actuator 432 is housed within the bottom sub 406 of the underreamer 400. To extend the cutter arms 422, a ball 446 is dropped through the drill string and pumped down to a ball drop sliding sleeve 444. Once the ball reaches the ball drop sliding sleeve 444, the sleeve moves down into the fixed ball drop sleeve 448.

Once the ball drop sliding sleeve 444 moves down to the fixed ball drop sleeve 448, fluid flows through the jets that are incorporated into the actuator 432. Fluid also flows through the ports in the fixed ball drop sleeve 448 that routes fluid back into the inner diameter of the bottom sub 406. Alternatively, the external control stimulus that activates the actuator 432 may be flow rate activated.

Figure 5A:
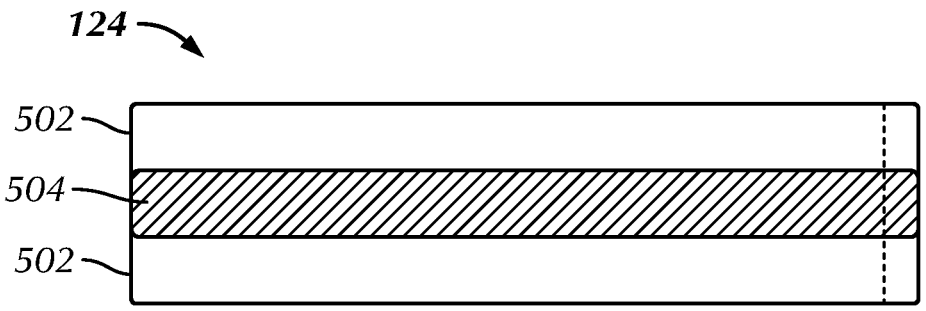
FIG. 5A is a back perspective view of a body insert, in accordance with one or more embodiments disclosed herein.
Figure 5B:
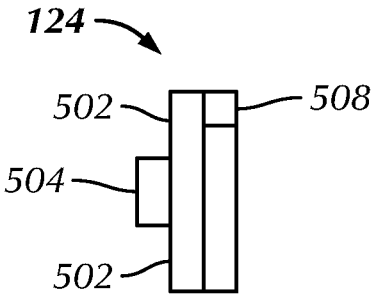
FIG. 5B is a side perspective view of a body insert, in accordance with one or more embodiments disclosed herein.
Figure 5C:
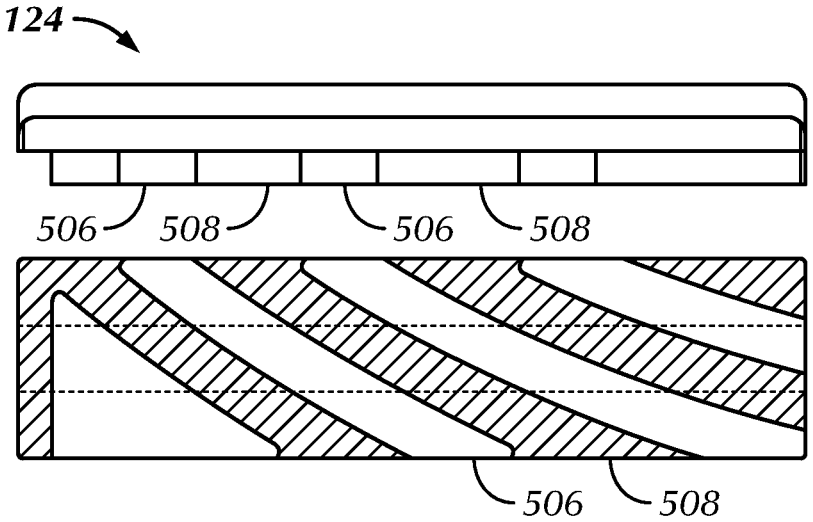
FIG. 5C is a top and front perspective view of a body insert, in accordance with one or more embodiments disclosed herein.

FIG. 5A is a back perspective view of a body insert 124, in accordance with one or more embodiments disclosed herein. The body insert 124 includes a raised projection 504 and recesses 502 that engage with the main body 104 so that body insert 124 can be installed within the main body 104. FIG. 5B demonstrates the projection 504 and recesses 502 in relation to a radial groove 506 and radial projection 508 on the front side of the body insert 124. Referring now to FIG. 5C, top and front perspectives of the body insert 124 are shown. The radial grooves 506 and radial projections 508 match those of the cutter arms 122. The grooves 506 are curved, thus increasing the translation distance of the cutter arms 122 and the relative point about which the cutter arms 122 will rotate, allowing for unique deployment and underreaming of a borehole and the ability to achieve a larger diameter of the underreamed hole than is possible with prior cutting assemblies.

Figure 6A:
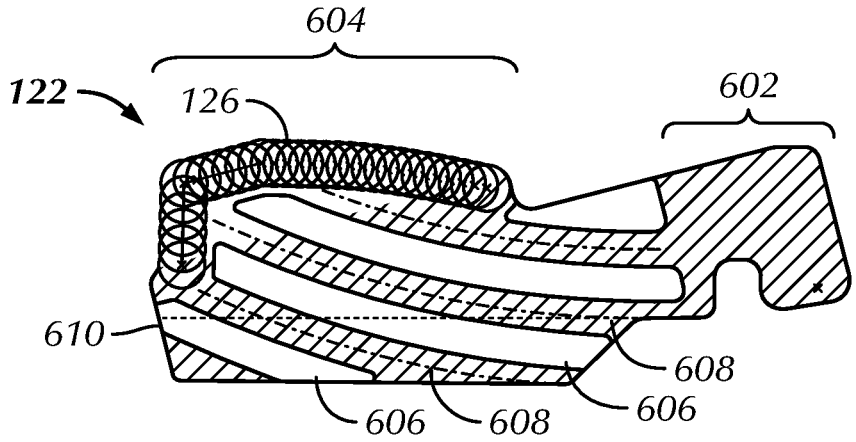
FIG. 6A is a front perspective view of a cutter arm, in accordance with one or more embodiments disclosed herein.
Figure 6B:
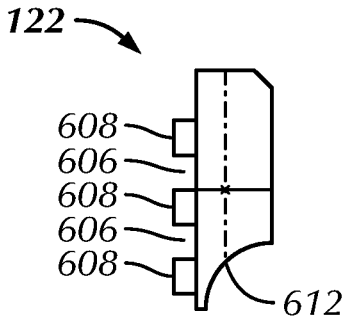
FIG. 6B is a side perspective view of a cutter arm, in accordance with one or more embodiments disclosed herein.
Figure 6C:
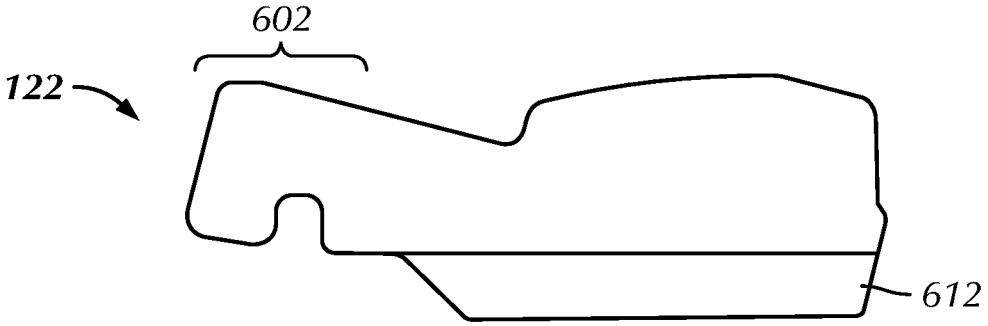
FIG. 6C is a back perspective view of a cutter arm, in accordance with one or more embodiments disclosed herein.

Referring generally to FIGS. 6A through 6C, FIG. 6A is a front perspective view of a cutter arm 122. The distal end 602 of the cutter arm 122 engages with the actuator 132 upon a sufficient hydraulic pressure drop to move the cutter arm 122 along radial grooves 120 of a body insert 124, that complement grooves 606 of the cutter arm 122. Upon extension from the tool, the cutter arm 122 abuts the stop block (not presently shown) to prevent full extension from the drilling tool assembly and transfer the mechanical forces acting on the cutter arms 122 to the stop block and main body of the drilling tool assembly.

The cutter arm 122 can support a variety of cutter means, including but not limited to roller cone cutters and hardened cutter elements such as tungsten carbide or polycrystalline diamond compact (PDC) cutters on the distal end of the cutter arm 122, depending on the particular needs of a job.

An arcuate surface 612 of the cutter arm 122 engages with the actuator 132 so that when the actuator 132 is activated, it abuts the arcuate surface 612 to urge the cutter arms 122 along the radial grooves 120 of the body insert 124, thus extending the cutter arms 122 from the underreamer 100.

While the downhole drilling assembly and cutting assembly have been described above in connection with various illustrative embodiments, it is to be understood that other similar embodiments may be used or modifications and additions may be made to the described embodiments for performing the same function disclosed herein without deviating therefrom. Further, all embodiments disclosed are not necessarily in the alternative, as various embodiments may be combined or subtracted to provide the desired characteristics. Variations can be made by one having ordinary skill in the art without departing from the spirit and scope hereof. The scope of the present disclosure is determined by the claims that follow.

What is claimed is:

1. A cutting assembly of a downhole drilling assembly comprising:

at least one body insert installed within a main body, the body insert having at least one radial projection on at least one side;

an extendable cutter arm having at least one radial groove slidably engaged with each radial projection of the body insert; and a hydraulically engaged actuator capable of urging the cutter arm along the at least one radial projection of the body insert, wherein the extendable cutter arm translates radially in relation to the at least one body insert along the at least one radial groove between an extended position and a retracted position.

2. The cutting assembly of claim 1, wherein the cutter arm pivot around an arc center of the at least one radial projection of the body insert when the cutting assembly rotates.

3. The cutting assembly of claim 1, further comprising a stop block with at least one face fully engaged with an interior surface of the downhole drilling assembly, wherein upon full extension of the cutter arm a shoulder abuts the stop block and mechanical forces acting on the cutter arm are transferred to the stop block and the main body of the downhole drilling assembly.

4. The cutting assembly of claim 1, wherein the cutter arm includes hardened cutter elements.

5. The cutting assembly of claim 1, wherein the cutter arm includes polycrystalline diamond compact cutter elements.

6. The cutting assembly of claim 1, wherein the cutter arm includes a roller cone.

7. A downhole drilling assembly comprising:

a tubular body with a fluid flow path, the tubular body comprising a main body moving telescopically within an outer body around the fluid flow path;

a plurality of body inserts displaced within the main body, the body inserts having circumferentially spaced radial grooves;

a plurality of moveable cutter arms with radial grooves complementary to and slidably engaged with the grooves of the body inserts and at least one stop block; and a hydraulically engaged actuator cooperatively engaged with the cutter arms, wherein the actuator is capable of extending the cutter arms radially, from the outer body until the cutter arm is seated against the at least one stop block to allow the cutter arm to rotate about a pivot point.

8. The downhole drilling assembly of claim 7, further comprising a plurality of jets installed within the actuator.

9. The downhole drilling assembly of claim 7, wherein the pivot point is an arc center of the radial grooves.

10. The downhole drilling assembly of claim 7, wherein:

the at least one stop block comprises an arcuate lower face adapted to fully engage a corresponding proximal edge surface of the outer body, and mechanical forces acting upon the cutter arms upon extension are supported by the at least one stop block and the outer body of the downhole drilling assembly.

11. A method of enlarging a borehole comprising: installing a downhole drilling assembly with a cutting assembly, the cutting assembly comprising a plurality of removable body inserts with a plurality of radial projections slidably engaged with at least two cutter arms, each cutter arm having a plurality of radial grooves; disposing the downhole drilling assembly at a desired location within the borehole; pressurizing a bore within the downhole drilling assembly to extend the cutter arms from the downhole drilling assembly along a radial translation path in relation to the body inserts; and rotating the downhole drilling assembly with the cutter arms in an extended position.

12. The method of claim 11, wherein the desired location is within casing of the borehole.

13. The method of claim 11, wherein the desired location is below casing of the borehole.

14. The method of claim 11, wherein the downhole drilling assembly further comprises a stop block adapted to abut a main body of the downhole drilling assembly and the cutter arms upon extension to absorb mechanical forces acting on the cutter arms and transfer the forces to the main body.

* * * * *